United States Patent [19]

Munnekehoff

[11] 4,126,279

[45] Nov. 21, 1978

[54] WINDING DEVICES FOR SPOOLING YARNS

[75] Inventor: Gerd Munnekehoff, Remscheid, Germany

[73] Assignee: Barmag Barmer Maschinenfabrik AG, Remscheid-Lennepp, Germany

[21] Appl. No.: 840,040

[22] Filed: Oct. 6, 1977

[30] Foreign Application Priority Data

Oct. 7, 1976 [DE] Fed. Rep. of Germany ..... 2645220

[51] Int. Cl.[2] ..... B65H 54/42; B65H 49/26

[52] U.S. Cl. ..... 242/18 DD; 242/129.51

[58] Field of Search ..... 242/18 DD, 129.51, 65, 242/66, 68.4

[56] References Cited

U.S. PATENT DOCUMENTS

| | | | |
|---|---|---|---|
| 2,743,061 | 4/1956 | Kingsbury | 242/18 DD |
| 2,757,874 | 8/1956 | Marcellus | 242/129.51 UX |
| 3,131,885 | 5/1964 | Furst et al. | 242/129.51 |
| 3,241,778 | 3/1966 | Bourgeas | 242/18 DD |
| 3,831,869 | 8/1974 | Sartori | 242/18 DD |
| 3,940,074 | 2/1976 | Laski et al. | 242/18 DD |
| 3,941,320 | 3/1976 | Strunk | 242/18 DD |

FOREIGN PATENT DOCUMENTS

| | | | |
|---|---|---|---|
| 1,351,592 | 5/1974 | United Kingdom | 242/18 DD |

*Primary Examiner*—Stanley N. Gilreath

*Attorney, Agent, or Firm*—Keil, Thompson & Shurtleff

[57] ABSTRACT

Winding device with two spaced arms pivotably mounted on a machine frame, each arm carrying a spool holding disc for holding therebetween a spool and the winding formed thereon, the swinging arm being jointed and being associated with a brake surface pressable against a contiguous spool holding disc.

4 Claims, 1 Drawing Figure

WINDING DEVICES FOR SPOOLING YARNS

Figure 1:
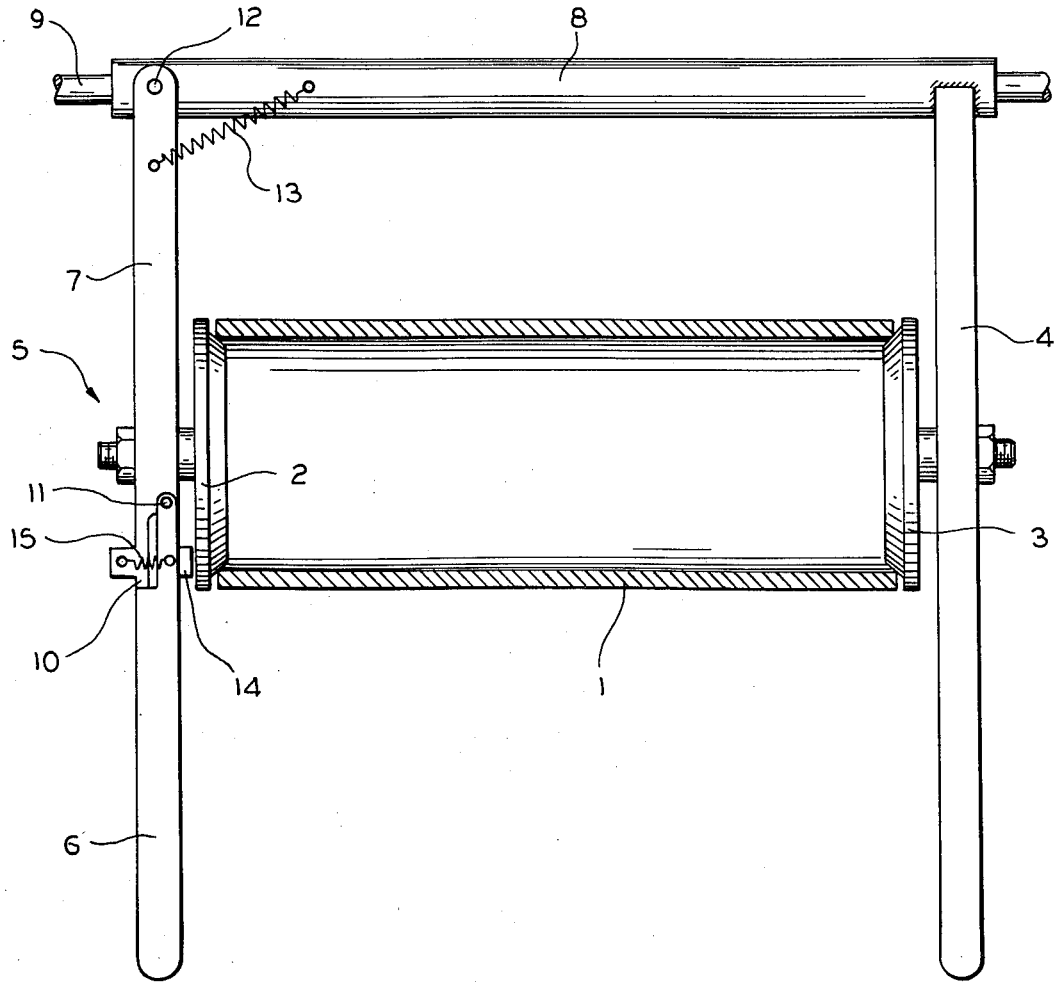

Up to now, it has been customary with false twist crimping machines when the yarn broke or a package was finished to separate the spools winding yarn at approximately 600 m/min. from the driving roller by lifting the spool holder from the roller, causing the spool to run out. Then, if necessary, the yarn was cut. The textured yarn which continued to be supplied had to be drawn off until the spool stopped. When the yarn broke, it could be tied together and wound further. When the spool was changed, the textured yarn had to be drawn off until a new spool case was inserted. The yarn was then attached again.

A relatively large amount of waste resulted from waiting for the spool to stop. It is not possible to brake each driving roller to reduce the run-out time since it is driven jointly with all of the other driving rollers in a false twist crimping machine.

Thus, a primary object of the invention is to provide a device on winding machines, in particular on false twist crimping machines, which attains quick and reliable braking of the spool which has been released from the drive roll and is still turning.

Such object, as well as others hereinafter appreciated by the following disclosure, are attained by using a horizontally pivotable arm which is forked to swing in the same plane and carrying thereon, or being operatively connected with, a brake member adapted to be moved into contact with said spool holder which is rotatably mounted on said arm. Furthermore, this solution can be used to particular advantage in automatic spool changing since it provides a certain run-out time and ensures then that the automatic spool changer will grasp a stopped spool. This eliminates in particular the possibility of damage to the last layers of winding. Furthermore, the solution has the advantage that no damage to the windings can occur during braking.

The combination according to the invention prevents a situation wherein only the braked spool holder is braked, while the spool itself--because of its inertia--continues to turn. Rather, the braking force simultaneously acts to increase friction on the point where the spool holder is clamped against the spool casing.

Further advantages result from the description of the invention. The illustrations show a schematic view of a winding station in a false twist crimping machine.

In the drawing

FIG. 1 is a top plan view of a winding station utilizing a friction-drive-roller-driven spool.

The spool casing 1 is held by the two clamping discs 2 and 3. These are rotatably mounted on arms 4 and 5 respectively so that they can rotate in opposed relationship. Arm 5 consists of two parts 6 and 7 which are pivotably joined by the fulcrum pin 11. The front part 6 serves as a brake lever, while the rear part 7 acts as a clamping lever. Brake part 6 is joined to clamping part 7 in such a way that when the part 6 swings outward—after bridging a small idle path—lever 7 is taken along by stop 10, an abutment provided on the arm 6.

Clamping arm 7 is flexibly jointed together at fulcrum 12 with a carrier member 8 while arm 4 is fixed to this carrier member. Carrier member 8 itself rotates around shaft 9. Shaft 9 is parallel to the longitudinal axis of the machine and is fixed to the machine frame. Instead of the shaft, it is of course possible to select any other revolving attachment.

To insert a spool case 1, braker lever part 6 is swung outward around its fulcrum 11, which also swings clamping lever part 7 around its fulcrum 12. The tension spring 13 turns clamping lever 7 back into its operating position. Tension spring 13 is designed in such a way that the spool case cannot slip off the clamping discs during the winding process.

The spool case is driven during operation by a driving roller (not shown). After the winding process ends, the spool with the winding is lifted from the driving roller. In order to make the spool change, it is necessary to brake the still-turning spool.

This is done by swinging brake lever 6 by hand toward spool case 1. When this is done, brake pad 14 is pressed against clamping disc 2. The resultant disc brake also safely and reliably brakes the spool since the pressure of clamping disc 2 and 3 against the ends of the spool case 1 is significantly increased because of the axially directed brake force.

To prevent brake disc 14 from unintentionally hitting centering plate 2 during the winding process, another tension spring 15 is used between brake lever 6 and clamping lever 7 to hold arm part 6 against shoulder 10.

After the spool case is braked, brake lever 6 is swung outward from spool case 1 so that the clamping part 7 is also swung outward by stop 10 so the spool case can be removed or can fall into a catching device placed below the spool case holder.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. A winding device for yarns comprising the combination of a two-armed spool holder having first and second arms mounted on a machine frame to pivot about a horizontal axis, said first arm also having pivot means for swinging said first arm toward and away from said second arm, opposed spool holders mounted rotatably on respective arms, whereby an empty spool may be inserted between, or a wound spool may be released from, said opposed spool holders, the improvement wherein said first arm is subdivided into an outer part and an inner part upon which one of said spool holders is mounted, said parts being connected by pivot means which allows said outer part to swing toward the last-mentioned spool holder, and a brake member operatively associated with said outer part to come into braking contact with said last-mentioned spool holder when said outer part is swung toward said last-mentioned spool holder.

2. A winding device as claimed in claim 1, wherein said brake member is a brake pad mounted on said outer part.

3. A winding device for yarns comprising a combination of a two-armed spool holder having first and second arms mounted on a frame and pivotable about a horizontal axis, said first arm also having first pivot means for swinging said first arm toward and away from said second arm and being horizontally spaced from said second arm, opposed spool holders mounted rotatably on respective arms, whereby an empty spool may be inserted between, or a wound spool may be released from, said opposed spool holders, the improvement wherein one of said arms is subdivided into inner and outer parts, said parts being connected by said pivot means, upon the inner part of which one of said spool holders is mounted, and upon the outer part a brake member is mounted, said outer part being pivotable toward said spool holder mounted on said inner part so that said brake member comes into braking contact with said last-mentioned spool holder.

4. A winding device for yarns, comprising the combination of a two-armed spool holder having first and second arms mounted on a frame and pivotable about a horizontal axis, said first arm also having first pivot means for swinging said first arm toward and away from said second arm and being horizontally spaced from said second arm, spring means for biasing said first arm toward said second arm, and opposed spool holders mounted rotatably on respective arms, whereby an empty spool may be inserted between, or a wound spool may be released from, said opposed spool holder, the improvement wherein said first arm is subdivided into inner and outer parts, said parts being connected by a second pivot means which allows said outer part to swing toward one of said spool holders, upon the inner part of which the last-mentioned spool holder is mounted, and a brake member operatively associated with said outer part to come into braking contact with said last-mentioned spool holder when said outer part is swung toward said last-mentioned spool holder.

* * * * *